US005752763A

United States Patent [19]

Chiang

[11] Patent Number: 5,752,763

[45] Date of Patent: May 19, 1998

[54] LIGHT BULB AND A LIGHT DEVICE USING THE SAME

[76] Inventor: Hank Chiang, No. 162, Chung-Chen S. Rd., Hsia-Jen Hsiang, Tainan Hsien, Taiwan

[21] Appl. No.: 792,807

[22] Filed: Feb. 3, 1997

[51] Int. Cl.[6] ..... F21L 7/00

[52] U.S. Cl. ..... 362/208; 362/204; 362/226

[58] Field of Search ..... 362/188, 203, 362/204, 205, 208, 226, 362

[56] References Cited

U.S. PATENT DOCUMENTS 5,664,870 9/1997 Uchida et al. ..... 362/226 X 5,678,921 10/1997 Kish et al. ..... 362/205

*Primary Examiner*—Stephen F. Husar

*Attorney, Agent, or Firm*—Finnegan, Henderson, Farabow, Garrett & Dunner, L.L.C.

[57] ABSTRACT

A light device includes a housing which has an end with a bulb mounting hole and a conductive plate around the bulb mounting hole, and a light bulb to extend through the bulb mounting hole. The light bulb has a base which includes a cylindrical contact portion and a tip contact portion. The cylindrical contact portion is free of screw threads and has an annular flange. A clamping member clamps the annular flange against the conductive plate so as to establish electrical connection between the light bulb and the conductive plate. The light bulb will not loosen upon impact.

7 Claims, 5 Drawing Sheets

LIGHT BULB AND A LIGHT DEVICE USING THE SAME

BACKGROUND OF THE INVENTION

1. Field of the Invention

This invention relates to a light bulb and a light device incorporating the same, more particularly to a light device having a bulb and a connecting system suitable for a torch.

2. Description of the Related Art

Referring to FIG. 1, a conventional torch is shown to comprise a conical conductive housing 21 with a central hole 211 and a conductive seat 212 in the central hole 211 for mounting a ring contact portion 221 of a bulb 22. A conductive torch barrel 23 has a top flange 231 to rotatably engage a side rim 213 of the housing 21. A shade 24 covers the housing 21. In use, the positive terminal 251 of a battery 25 contacts the tip contact portion 222 of the bulb 22 while the negatively charged outer wall of the battery 25 abuts against the torch barrel 23.

The ring contact portion 221 is connected electrically to the conductive seat 212, the conductive housing 21 and then to the torch barrel 23 which is in contact with the negatively charged outer wall of the battery 25. On the other hand, the tip contact portion 222 of the bulb 22 contacts the positive terminal 251. Operation of an on-off switch can make electrical connection to light the bulb 22.

However, because the ring contact portion 221 is threaded in the conductive seat 212, when the torch is subjected to impacts, the ring contact portion 221 tends to loosen in the conductive seat 212, thereby adversely affecting conductivity.

SUMMARY OF THE INVENTION

The main object of the present invention is to provide an improved light device having a light bulb and its connecting system, which can overcome the drawback that is commonly associated with the aforementioned prior art.

According to this invention, a light device includes a housing which has an end with a bulb mounting hole and a conductive plate around the bulb mounting hole, and a light bulb to extend through the bulb mounting hole. The light bulb has a base which includes a cylindrical contact portion and a tip contact portion. The cylindrical contact portion is free of screw threads and has an annular flange. A clamping member clamps the annular flange against the conductive plate so as to establish electrical connection between the light bulb and the conductive plate. The light bulb will not loosen upon impact.

BRIEF DESCRIPTION OF THE DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
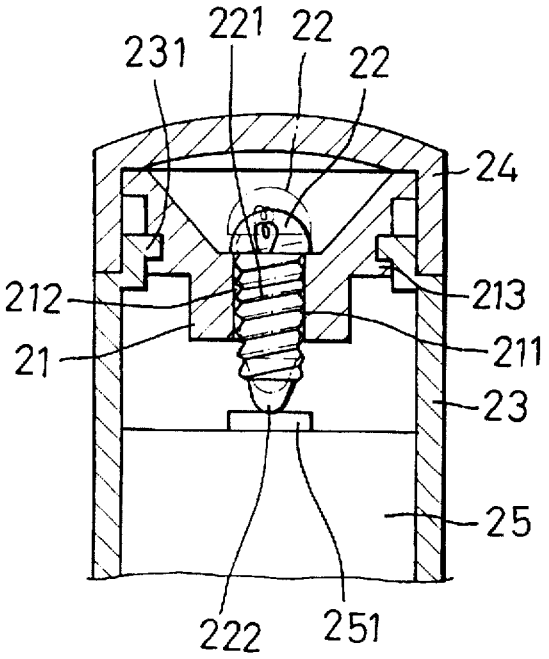
FIG. 1 PRIOR ART
FIG. 1 is a sectional view of a portion of a conventional torch.
Figure 2:
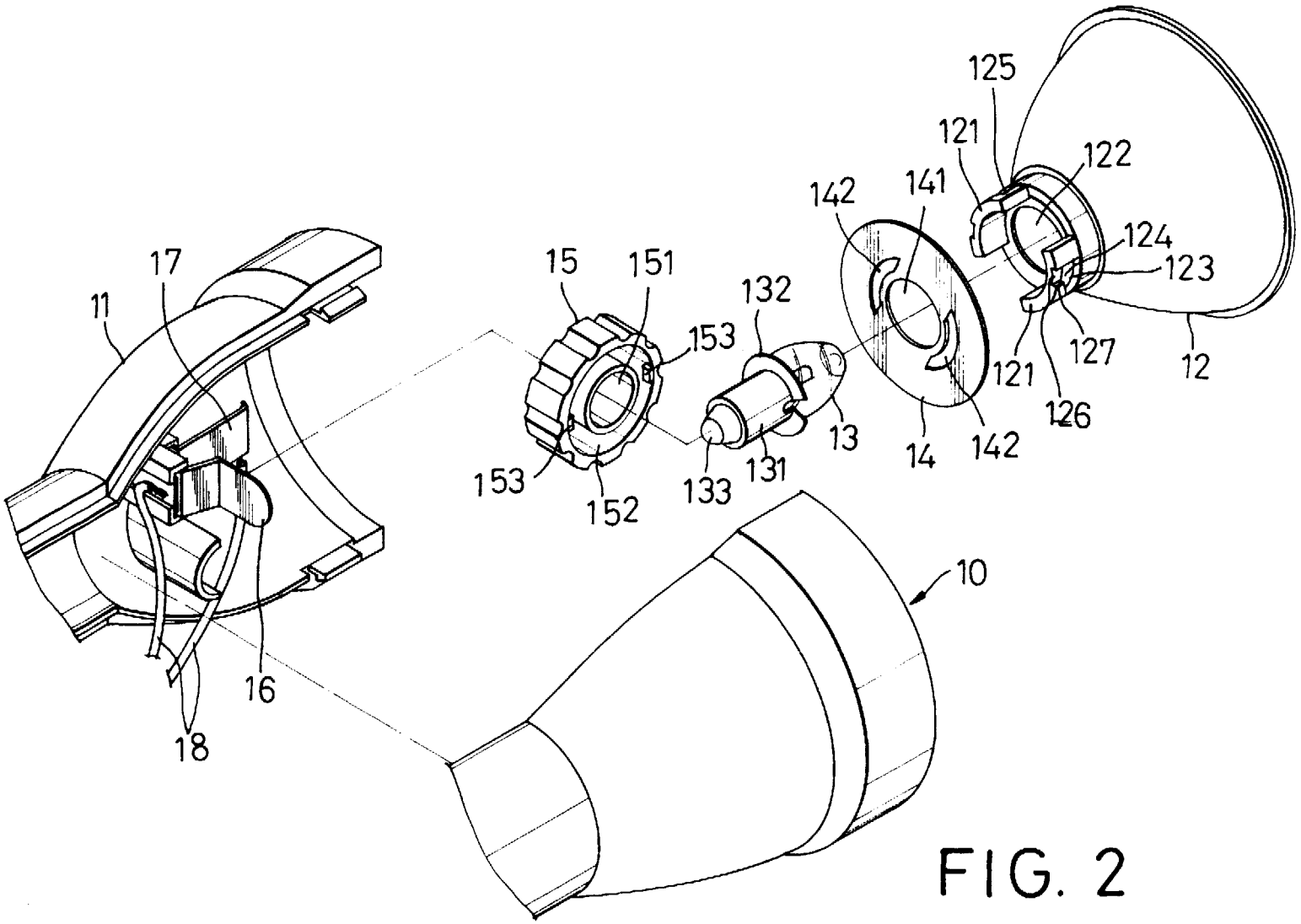
FIG. 2 is an exploded view of a portion of a light device or a torch incorporating a preferred embodiment of the present invention.

Referring to FIG. 2, the preferred embodiment of the light device 10 according to the present invention is shown to comprise a conical housing 12 which has a tapered bottom end, an extension having two arched projecting members 121 that extend downward and axially from the bottom end, a bulb mounting hole 122, and a conductive plate 14 around the bulb housing hole 122.

Each projecting member 121 has a guiding slot 123. The guiding slot 123 includes a longitudinal section 124 which extends toward the bottom edge 1211 to confine an entrance portion 126, and a transverse locking section 125 which is substantially perpendicular to the longitudinal section 124 and which has a proximal end communicated with the longitudinal section 124 and a distal gradually narrowed end.

The conductive plate 14 has a central through hole 141, and two arcuate holes 142 which are provided at two sides of the central through hole 141. The conductive plate 14 is sleeved on the projecting members 121 via the arcuate holes 142.

A light bulb 13 passes through the through hole 141 and the bulb mounting hole 122 and has a base which includes a cylindrical contact portion 131 that has a annular flange 132, and a tip contact portion 133. The annular flange 132 is parallel to and contacts the conductive plate 14.

A clamping member 15 has an annular inner surrounding wall 151 which is sleeved on the cylindrical contact portion 131, an annular outer surrounding wall 152 which is sleeved on the arched projecting members 121, and two locking projections 153 protruding inward from the outer surrounding wall 152 to enter respectively the guiding slot 123 from the entrance portions 126 and to be positioned in the locking sections 125 so as to lock the bulb 13.

Figure 3:
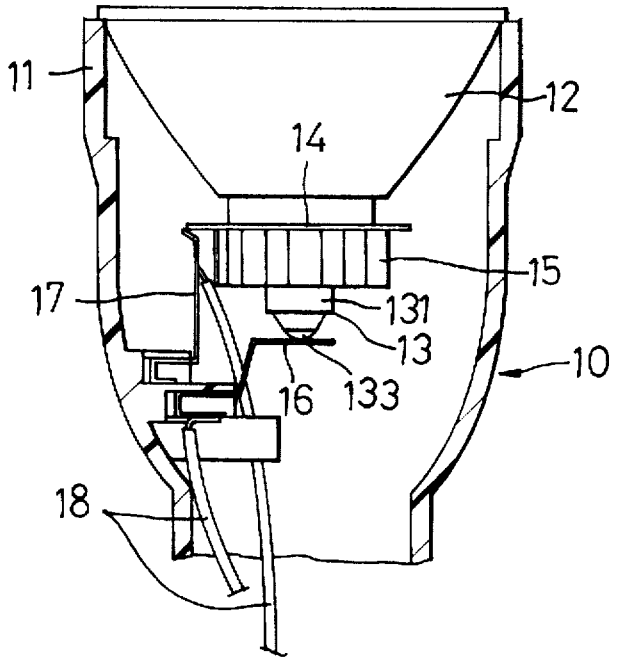
FIG. 3 is a sectional view of the torch of FIG. 2 when assembled.

With reference to FIG. 3, the tip contact portion 133 of the light bulb 13 contacts to a first metal tongue 16. The conductive plate 14 contacts a second metal tongue 17 in the light device 10. Then, the first and second metal tongues 16, 17 are respectively contact to two wires 18 for connection with a battery (not shown).

Figure 4:
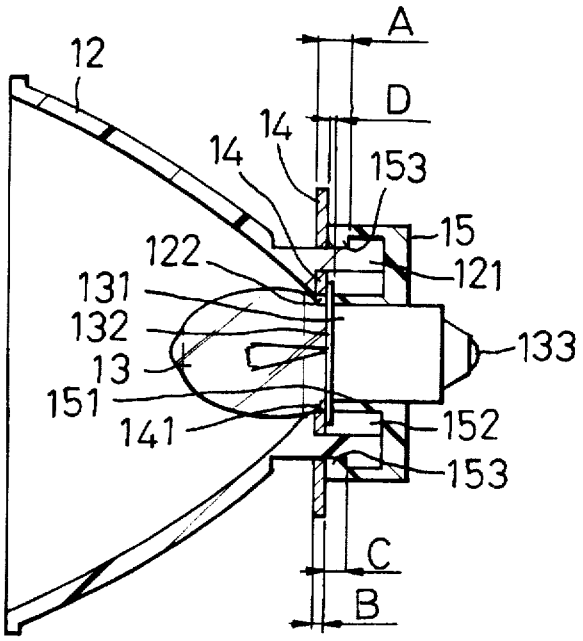
FIG. 4 is a sectional view illustrating how a bulb is mounted in a housing of the light device.
Figure 5:
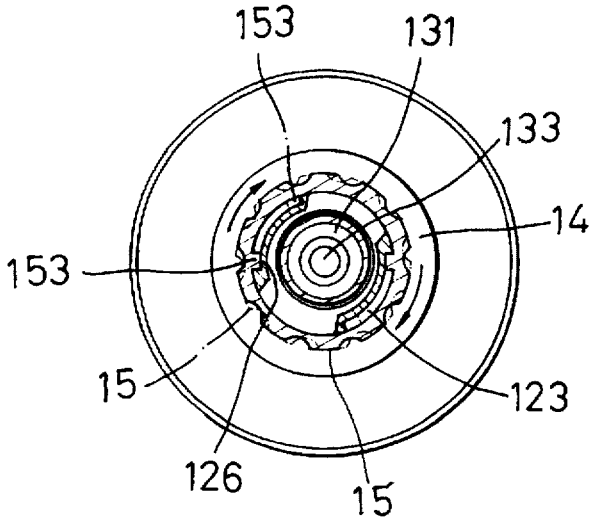
FIG. 5 is a sectional view illustrating the interlocking of an extension of the housing with a clamping member of the light device.

In assembly, referring to FIGS. 2, 4 and 5, the projecting members 121 are respectively inserted in the arcuate holes 142. The light bulb 13 is passed through the through hole 141 and the bulb mounting hole 122, and the annular flange 132 abuts against the conductive plate 14. The inner surrounding wall 151 of the clamping member 15 is sleeved on the cylindrical contact portion 131, and the projections 153 are respectively inserted in the longitudinal sections 124 from the entrance portions 126. Finally, the clamping member 15 is rotated so that the projections 153 enter the locking sections 125 to clamp the annular flange 132 against the conductive plate 14.

The depth (A) of the locking section 125 is generally similar to the sum of the thickness (B) of the conductive plate 14, the thickness (C) of the annular flange 132 and the thickness (D) of the projection 153. Thus, when the clamping member 15 clamps the conductive plate 14 and the annular flange 132 against the tapered end of the conductive housing 12, the projections 153 are respectively locked tightly in the locking sections 125, thereby interlocking the clamping member 15 and the projecting members 121 and establishing a stable electrical connection between the conductive plate 14 and the light bulb 13. Thus, the bulb 13 will not loosen upon impact.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A light bulb for mounting to a light device having a housing with an end formed with a bulb mounting hole and a conductive plate around said bulb mounting hole, comprising:

a bulb having a base including a cylindrical contact portion which has an annular flange and which is free of screw threads, and a tip contact portion, said annular flange being capable of being clamped against the conductive plate so as to establish electrical connection between said light bulb and the conductive plate.

2. A light device, comprising:

a housing having an end with a bulb mounting hole, said housing having a conductive plate at said end around said bulb mounting hole;

a light bulb extending through said bulb mounting hole, said light bulb having a base including a cylindrical contact portion and a tip contact portion, said cylindrical contact portion being free of screw threads and having an annular flange; and means for clamping said annular flange against said conductive plate so as to establish an electrical connection between said light bulb and said conductive plate.

3. A light device as claimed in claim 2, wherein said end of said housing has an extension which extends outwardly and axially from said end and which passes through said conductive plate to extend over said cylindrical contact portion.

4. A light device as claimed in claim 3, wherein said clamping means is sleeved around said extension and is interlocked therewith to clamp said annular flange against said conductive plate.

5. A light device as claimed in claim 4, wherein said extension has two opposite arched projecting members.

6. A light device as claimed in claim 5, wherein said clamping means has an annular outer surrounding wall to be sleeved on said arched projecting members, an annular inner surrounding wall to be sleeved on said cylindrical contact portion, and locking projections in said outer surrounding wall.

7. A light device as claimed in claim 6, wherein each of said arched projecting members has a guiding slot for guiding and interlocking with one of said locking projections, said guiding slot having an entrance portion and a locking end portion communicated with said entrance portion.

* * * * *